US010619951B2

(12) United States Patent
Tong et al.

(10) Patent No.: US 10,619,951 B2
(45) Date of Patent: Apr. 14, 2020

(54) PHASE TRANSITION SUPPRESSION HEAT TRANSFER PLATE-BASED HEAT EXCHANGER

(71) Applicant: ZHEJIANG JIAXI OPTOELECTRONIC EQUIPMENT MANUFACTURING CO., LTD., Jiashan, Zhejiang (CN)

(72) Inventors: Aixing Tong, Zhejiang (CN); Juqiang Li, Zhejiang (CN)

(73) Assignee: ZHEJIANG JIAXI OPTOELECTRONIC EQUIPMENT MANUFACTURING CO., LTD., Jiashan, Zhejiang (CN)

( * ) Notice: Subject to any disclaimer, the term of this patent is extended or adjusted under 35 U.S.C. 154(b) by 247 days.

(21) Appl. No.: 15/739,990

(22) PCT Filed: May 19, 2016

(86) PCT No.: PCT/CN2016/082585

§ 371 (c)(1),
(2) Date: Apr. 20, 2018

(87) PCT Pub. No.: WO2017/020629

PCT Pub. Date: Feb. 9, 2017

(65) Prior Publication Data

US 2019/0093966 A1 Mar. 28, 2019

(30) Foreign Application Priority Data

Aug. 6, 2015 (CN) ..... 2015 1 04778350

(51) Int. Cl.
*F28F 23/02* (2006.01)
*F28F 3/14* (2006.01)
(Continued)

(52) U.S. Cl.
CPC ..... *F28F 23/02* (2013.01); *F28D 1/0316* (2013.01); *F28D 15/0233* (2013.01); *F28F 3/14* (2013.01)

(58) Field of Classification Search
CPC ..... F28F 23/02; F28F 3/14; F28D 1/0316; F28D 15/0233
(Continued)

(56) References Cited

U.S. PATENT DOCUMENTS

| | | | | |
|---|---|---|---|---|
| 5,520,244 | A | 5/1996 | Mundinger et al. | |
| 2010/0065244 | A1* | 3/2010 | Yokoyama | F28D 1/05383 165/10 |
| 2015/0198383 | A1* | 7/2015 | Kitoh | F28D 20/02 165/10 |

FOREIGN PATENT DOCUMENTS

| | | |
|---|---|---|
| CN | 202102836 U | 1/2012 |
| CN | 103822515 A | 5/2014 |

(Continued)

*Primary Examiner* — Joel M Attey
(74) *Attorney, Agent, or Firm* — Global IP Services; Tianhua Gu

(57) ABSTRACT

A phase change suppression heat transfer plate-type heat exchanger comprises an inlet communication header pipe, an outlet communication header pipe and a plurality of phase change suppression heat transfer heat exchange plates arranged in parallel. The phase change suppression heat transfer heat exchange plate is provided with a liquid pipeline of a certain structure shape and a closed network-shaped pipeline of a certain structure shape. The closed network-shaped pipeline is filled with a phase change suppression working medium. The inlet communication header pipe and the outlet communication header pipe are at least fixed at one side of the phase change suppression heat transfer heat exchange plate. The lengthwise directions of the inlet communication header pipe and the outlet communication header pipe extend along the parallel arrangement
(Continued)

direction of the plurality of phase change suppression heat transfer heat exchange plates.

12 Claims, 8 Drawing Sheets

(51) Int. Cl.
*F28D 1/03* (2006.01)
*F28D 15/02* (2006.01)

(58) Field of Classification Search
USPC ..... 165/170
See application file for complete search history.

(56) References Cited

FOREIGN PATENT DOCUMENTS

| | | | |
|---|---|---|---|
| CN | 105004206 | A | 10/2015 |
| CN | 204944261 | U | 1/2016 |

* cited by examiner

PHASE TRANSITION SUPPRESSION HEAT TRANSFER PLATE-BASED HEAT EXCHANGER

CROSS REFERENCE TO RELATED PATENT APPLICATION

The present application is the US national stage of PCT/CN2016/082585 filed on May 19, 2016, which claims the priority of the CN2015104778350 filed on Aug. 6, 2015, which application is incorporated herein by reference.

BACKGROUND OF THE PRESENT INVENTION

Field of Invention

The present invention relates to a heat exchanger, and in particular relates to a phase change suppression heat transfer plate-type heat exchanger.

Description of Related Arts

Gas-liquid heat exchangers are widely applied in the fields such as automobile heat sinks, evaporator and condenser of air conditioners, liquid cooling system of High-speed Railway traction system converters, wind-electricity converter cooling systems, data centers and so on. With the rapid development of technology, the requirements to the heat exchangers are higher and higher, which not only requires high heat exchange efficiency, small volume and light weight but also requires small noise, easy maintenance and low costs.

Currently used gas-liquid heat exchangers mainly employ a copper pipe expanding outwards to connect to an aluminum heat sink exchanger. That is, the liquid pipeline is a wound copper pipe. The copper pipe expands outwards to connect to an aluminum heat sink group. The liquid flows in the pipe and conducts heat to the heat sink through the pipe wall. The air is driven by a fan to flow through the heat sink and take away heat to reduce the liquid temperature in the pipe, realizing the purpose of dissipating the heat of the liquid to cooled air and cooling the system. Since the liquid pipeline is connected in series, the pipeline is long, the flowing resistance is large, there is contact heat resistance between the fin outside the pipeline and the liquid pipeline, the heat conduction coefficient of the employed heat sink is 200 W/m.k, the efficiency of the fin is relatively low, and the dimension of the fin is relatively small, the length of the liquid pipeline and the number of fins need to be increased to meet the heat dissipation demand, which also increase the weight and volume of the heat exchanger and at the same time increases the power consumption of liquid circulation, increasing system costs, volume and weight.

SUMMARY OF THE PRESENT INVENTION

In view of the defects in the prior art, an object of the present invention is to provide a phase change suppression heat transfer plate-type heat exchanger for solving the problems in the prior art that the liquid pipeline is long, the flowing resistance is large and the efficiency of the heat sink is low since the copper pipe expands outwards to connect to an aluminum heat sink exchanger, to greatly increase the fin efficiency and heat dissipation capability of the gas-liquid heat exchanger, reduce the length of the liquid pipeline and the flowing resistance so as to meet the heat dissipation demand of a large-power heat exchange system.

In order to realize the above object and other relevant objects, the present invention relates to a phase change suppression heat transfer plate-type heat exchanger, comprising: an inlet communication header pipe, an outlet communication header pipe and a plurality of phase change suppression heat transfer heat exchange plates arranged in parallel, wherein the phase change suppression heat transfer heat exchange plate is of a composite plate-type structure and is provided with a liquid pipeline of a certain structure shape and a closed network-shaped pipeline of a certain structure shape, wherein the closed network-shaped pipeline is filled with a phase change suppression working medium;

the inlet communication header pipe and the outlet communication header pipe are at least fixed at one side of the phase change suppression heat transfer heat exchange plate, the lengthwise directions of the inlet communication header pipe and the outlet communication header pipe extend along the parallel arrangement direction of the plurality of phase change suppression heat transfer heat exchange plates, and the interiors of the inlet communication header pipe and the outlet communication header pipe both communicate with the interior of the liquid pipeline.

As a preferred solution of the phase change suppression heat transfer plate-type heat exchanger in the present invention, the liquid pipeline and the closed network-shaped pipeline are both formed by means of an inflation process, and a first projection structure corresponding to the closed network-shaped pipeline and a second projection structure corresponding to the liquid pipeline are formed on a surface of the phase change suppression heat transfer heat exchange plate.

As a preferred solution of the phase change suppression heat transfer plate-type heat exchanger in the present invention, the first projection structure and the second projection structure are respectively formed on different surfaces of the phase change suppression heat transfer heat exchange plate.

As a preferred solution of the phase change suppression heat transfer plate-type heat exchanger in the present invention, the phase change suppression heat transfer heat exchange plate includes a middle plate, a first plate and a second plate; the first plate, the middle plate and the second plate are stacked successively, the first plate and the second plate are respectively located at two sides of the middle plate and composited with the middle plate by means of a rolling process;

the closed network-shaped pipeline is located between the middle plate and the first plate, and the first projection structure is located on the first plate; and the liquid pipeline is located between the middle plate and the second plate, and the second projection structure is located on the second plate.

As a preferred solution of the phase change suppression heat transfer plate-type heat exchanger in the present invention, the inlet communication header pipe and the outlet communication header pipe are respectively formed on two opposite sides of the phase change suppression heat transfer heat exchange plate; and the shape of the liquid pipeline is a rectilinear figure.

As a preferred solution of the phase change suppression heat transfer plate-type heat exchanger in the present invention, the liquid pipeline is located on a longitudinal central line of the phase change suppression heat transfer heat exchange plate.

As a preferred solution of the phase change suppression heat transfer plate-type heat exchanger in the present invention, the liquid pipeline is close to one side of the phase change suppression heat transfer heat exchange plate.

As a preferred solution of the phase change suppression heat transfer plate-type heat exchanger in the present invention, the inlet communication header pipe and the outlet communication header pipe are located on the same side of the phase change suppression heat transfer heat exchange plate; and the shape of the liquid pipeline is of a U shape.

As a preferred solution of the phase change suppression heat transfer plate-type heat exchanger in the present invention, the first projection structure and the second projection structure are formed on the same surface of the phase change suppression heat transfer heat exchange plate.

As a preferred solution of the phase change suppression heat transfer plate-type heat exchanger in the present invention, the first projection structure and the second structure are both formed on two surfaces of the phase change suppression heat transfer heat exchange plate.

As a preferred solution of the phase change suppression heat transfer plate-type heat exchanger in the present invention, the phase change suppression heat transfer heat exchange plate includes a first plate and a second plate; and the first plate and the second plate are composited together by means of a rolling process; and the closed network-shaped pipeline and the liquid pipeline are located between the first plate and the second plate; and the first projection structure and the second projection structure are located on the first plate, on the second plate, or both on the first plate and the second plate.

As a preferred solution of the phase change suppression heat transfer plate-type heat exchanger in the present invention, the inlet communication header pipe and the outlet communication header pipe are respectively formed at two ends of the phase change suppression heat transfer heat exchange plate; and the shape of the liquid pipeline is a rectilinear figure and the liquid pipeline is close to one side of the phase change suppression heat transfer heat exchange plate.

As a preferred solution of the phase change suppression heat transfer plate-type heat exchanger in the present invention, one end of the inlet communication header pipe and the outlet communication header pipe is closed and the other end is connected to a liquid system.

As a preferred solution of the phase change suppression heat transfer plate-type heat exchanger in the present invention, the surface of the phase change suppression heat transfer heat exchange plate is perpendicular to the inlet communication header pipe and the outlet communication header pipe or tilts to a certain angle relative to the inlet communication header pipe and the outlet communication header pipe.

The phase change suppression heat transfer plate-type heat exchanger provided in the present invention has the following beneficial effects: in the phase change suppression heat transfer heat exchange plate of the phase change suppression heat transfer plate-type heat exchanger, the liquid pipeline and the closed network-shaped pipeline are combined together, a phase change suppression working medium is filled in the closed network-shaped pipeline to form a phase change suppression heat transfer device, which improves the temperature equalization performance of the phase change suppression heat transfer heat exchange plate; as the heat conduction efficiency of the phase change suppression heat transfer device is high and the temperature equalization performance is good, the heat exchange temperature difference and the effective heat exchange area between the phase change suppression heat transfer device and the air is improved, the heat dissipation capability and heat exchange efficiency of the phase change suppression heat transfer heat exchange plate is greatly improved; so that the phase change suppression heat transfer plate-type heat exchanger has features of temperature equalization and efficient heat exchange, which greatly shortens the length of the liquid pipeline, reduces flow resistance and power consumption and fluid use amount, and improves the efficiency and energy efficiency ratio of the heat exchanger.

DESCRIPTION OF COMPONENT MARK NUMBERS

Figure 1:
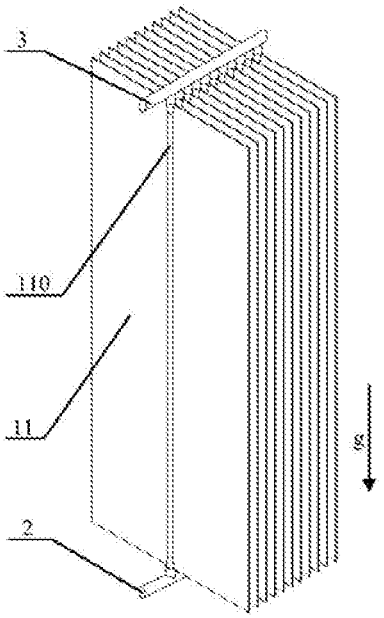
FIG. 1 illustrates a perspective structure view of a phase change suppression heat transfer plate-type heat exchanger according to embodiment I of the present invention.

11 phase change suppression heat transfer heat exchange plate
2 inlet communication header pipe
3 outlet communication header pipe
102 inlet connection pipe
103 outlet connection pipe
104 non-liquid pipeline portion
105 second projection structure
106 non-network-shaped pipeline portion
107 first projection structure
108 network-shaped pipeline
109 phase change suppression working medium
110 liquid pipeline
111 first plate
112 middle plate
113 second plate
α an included angle between the phase change suppression heat transfer heat exchange plate and the horizontal plane when the inlet communication header pipe is perpendicular to the horizontal plane

DETAILED DESCRIPTION OF THE PREFERRED EMBODIMENTS

The embodiments of the present invention will be described by way of specific embodiments, and those skilled in the art may readily understand other advantages and effects of the present invention from the disclosure of the present invention. The present invention may also be implemented or applied with other different particular embodiments, and various details in the description may also be modified or varied without departing from the spirit of the present invention based on different viewpoints and applications.

Referring to FIGS. 1 to 17, it should be noted that the figures according to this embodiment describe the basic concept of the present invention merely in an illustrative way. Although the figures merely show components related in the present invention and are not drawn according to the number, shape and size of components during actual implementation, the model, number and proportion of the components during actual implementation may be changed arbitrarily and the layout and model of the components may also be more complicated.

Embodiment 1

Referring to FIGS. 1 to 4, the present invention provides a phase change suppression heat transfer plate-type heat exchanger, including: an inlet communication header pipe 2, an outlet communication header pipe 3 and a plurality of phase change suppression heat transfer heat exchange plates 11 arranged in parallel; the surfaces of the phase change suppression heat transfer heat exchange plates 11 are parallel to each other, the phase change suppression heat transfer heat exchange plate 11 is a composite plate structure, the phase change suppression heat transfer heat exchange plates 11 is provided with a liquid pipeline 110 of a certain structure shape and a closed network-shaped pipeline 108 of a certain structure shape, wherein the closed network-shaped pipeline 108 is filled with a phase change suppression working medium 109; the inlet communication header pipe 2 and the outlet communication header pipe 3 are at least fixed at one side of the phase change suppression heat transfer heat exchange plate 11, the lengthwise directions of the inlet communication header pipe 2 and the outlet communication header pipe 3 extend along the parallel arrangement direction of the plurality of phase change 6 suppression heat transfer heat exchange plates 11, and the interiors of the inlet communication header pipe 2 and the outlet communication header pipe 3 both communicate with the interior of the liquid pipeline 110.

As an example, the inlet communication header pipe 2 and the outlet communication header pipe 3 are respectively formed on two opposite sides of the phase change suppression heat transfer heat exchange plate 11. The surface of the phase change suppression heat transfer heat exchange plate 11 may be perpendicular to the inlet communication header pipe 2 and the outlet communication header pipe 3 or tilt to a certain angle relative to the inlet communication header pipe 2 and the outlet communication header pipe 3. For example, the phase change suppression heat transfer heat exchange plate 11 may tilt to an angle of 5°~90° relative to the inlet communication header pipe 2 and the outlet communication header pipe 3. Preferably, the surface of the phase change suppression heat transfer heat exchange plate 11 may be perpendicular to the inlet communication header pipe 2 and the outlet communication header pipe 3.

As an example, one end of the inlet communication header pipe 2 and the outlet communication header pipe 3 is closed and the other end is connected to a liquid system (not shown).

As an example, the phase change suppression working medium 109 is fluid. Preferably, the phase change suppression working medium 109 may be gas or liquid or a mixture of gas and liquid. More preferably, in this embodiment, the phase change suppression working medium 109 is a mixture of gas and liquid.

As an example, the liquid pipeline 110 and the closed network-shaped pipeline 108 are both formed by means of an inflation process, and a first projection structure 107 corresponding to the closed network-shaped pipeline 108 and a second projection structure 105 corresponding to the liquid pipeline 110 are formed on a surface of the phase change suppression heat transfer heat exchange plate 11.

As an example, the first projection structure 107 and the second projection structure 105 are respectively formed on different surfaces of the phase change suppression heat transfer heat exchange plate 11.

Figure 4:
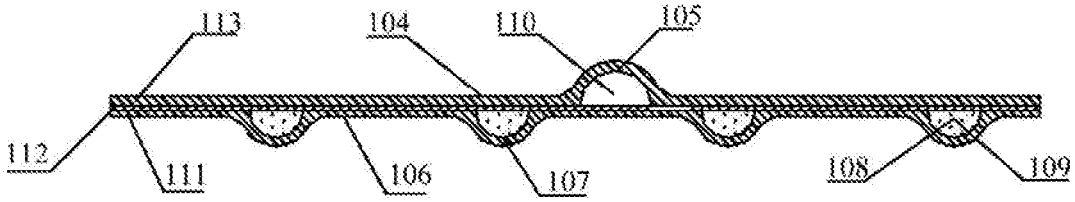
FIG. 4 illustrates a partial section structure view of the phase change suppression heat transfer heat exchange plate in the phase change suppression heat transfer plate-type heat exchanger according to embodiment I of the present invention.

As an example, referring to FIG. 4, the phase change suppression heat transfer heat 2 2 exchange plate 11 includes a middle plate 112, a first plate 111 and a second plate 113; the first plate 111, the middle plate 112 and the second plate 113 are stacked successively, the first plate 111 and the second plate 113 are respectively located at two sides of the middle plate 112 and composited with the middle plate 112 by means of a rolling process; the closed network-shaped pipeline 108 is located between the middle plate 112 and the first plate 1 111, the first projection structure 107 is located on the first plate 111, the liquid pipeline 110 is formed between the middle plate 112 and the second plate 113, and the second projection structure 105 is located on the second plate 113. In the phase change suppression heat transfer heat exchange plate 11 of the phase change suppression heat transfer plate-type heat exchanger, the liquid pipeline 110 and the closed network-shaped pipeline 108 are combined together. As the heat conduction efficiency of the phase change suppression heat transfer heat exchange plate 11 is high and the temperature equalization performance is good, the heat exchange temperature difference and the effective heat exchange area between the phase change suppression heat transfer heat exchange plate 11 and the air is improved, the heat dissipation capability and heat exchange efficiency of the phase change suppression heat transfer heat exchange plate 11 is greatly improved, the phase change suppression heat transfer plate-type heat exchanger is enabled to have features of temperature equalization and efficient heat exchange, the length of the liquid pipeline 110 is greatly shortened, flow resistance and power consumption and fluid use amount is reduced, and the efficiency and energy efficiency ratio of the heat exchanger is improved.

Figure 2:
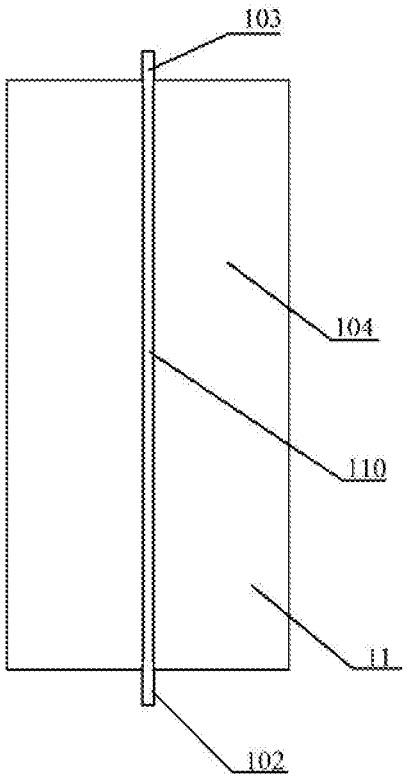
FIG. 2 illustrates a structure view of a liquid pipeline in a phase change suppression heat transfer heat exchange plate in the phase change suppression heat transfer plate-type heat exchanger according to embodiment I of the present invention.

As an example, the shape of the liquid pipeline 110 may be designed according to the actual needs. As shown in FIG. 2, the shape of the liquid pipeline 110 in this example may be for example a rectilinear figure but it is not limited in this embodiment. As shown in FIG. 2, the shape of the liquid pipeline 110 in this example is a rectilinear figure. The rectilinear tubulus structure is the liquid pipeline 110. A non-liquid pipeline portion 104 is located at two sides of the liquid pipeline 110. One end of the liquid pipeline 110 is the inlet connection pipe 102, and the other end is the outlet connection pipe 103. The liquid pipeline 110 communicates with the inlet communication header pipe 2 and the outlet communication header pipe 3 via the inlet connection pipe 102 and the outlet connection pipe 103.

As an example, the liquid pipeline 110 is located on a longitudinal central line of the phase change suppression heat transfer heat exchange plate 11.

As an example, the shape of the network-shaped pipeline portion 108 may be a hexagonal honeycomb, a circular honeycomb, a quadrilateral honeycomb, a plurality of U shapes, diamonds, triangles, or circular ring shapes that are connected in series, or any combination thereof.

Figure 3:
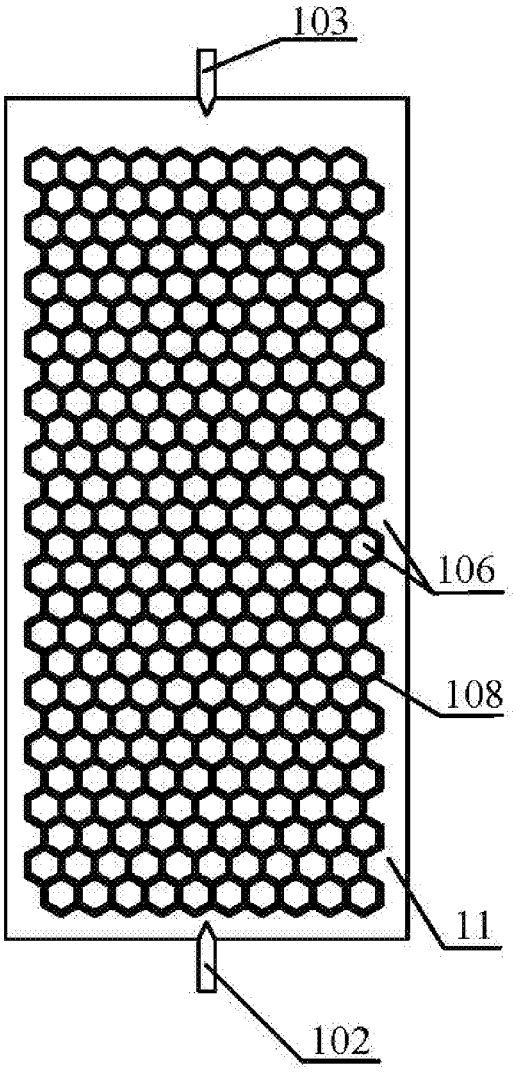
FIG. 3 illustrates a structure view of a closed network-shaped pipeline in the phase change suppression heat transfer heat exchange plate in the phase change suppression heat transfer plate-type heat exchanger according to embodiment I of the present invention.

FIG. 3 illustrates the shape of the network-shaped pipeline portion 108 being a hexagonal honeycomb. As shown in FIG. 3, the edge portion and the hexagonal portion of the phase change suppression heat transfer heat exchange plate 11 are a non-network-shaped pipeline portion 106 and the structures surrounding each hexagon and communicating with each other are the network-shaped pipeline portion 108.

As an example, the material of the phase change suppression heat transfer heat exchange plate 11 (that is, the materials of the middle plate 8, the first plate 7 and the second plate 9) shall be a material with good heat conduction performance. Preferably, in this embodiment, the material of the phase change suppression heat transfer heat exchange plate 11 may be copper, copper alloy, aluminum, aluminum alloy, titanium, titanium alloy, or a combination of any of the above.

Continuing referring to FIG. 1, the installation direction of the phase change suppression heat transfer plate-type heat exchanger may be as shown in FIG. 1. In FIG. 1, the arrow indicated with g represents the direction of gravity, that is, the vertically downward direction. At this moment, the phase change suppression heat transfer heat exchange plate 11 and the liquid pipeline 110 are both vertically downward and perpendicular to the horizontal plane. The inlet communication header pipe 2 is located below the phase change suppression heat transfer heat exchange plate 11. The outlet communication header pipe 3 is located above the phase change suppression heat transfer heat exchange plate 11. The outlet communication header pipe 2 and the inlet communication header pipe 3 are both parallel to the horizontal plane.

It should be noted that FIG. 1 merely illustrates an example of a preferred installation direction of the phase change suppression heat transfer plate-type heat exchanger. In this embodiment, the installation direction of the phase change suppression heat transfer plate-type heat exchanger is not limited to the installation manner shown in FIG. 1. In other examples, the installation direction of the phase change suppression heat transfer plate-type heat exchanger may be rotated towards the left or right by 90 degrees, 180 degrees or 270 degrees on the basis of the installation direction shown in FIG. 1 and may also be rotated towards the front or back by 90 degrees, 180 degrees or 270 degrees on the basis of the installation direction shown in FIG. 1.

During the operation of the phase change suppression heat transfer plate-type heat exchanger in the present invention, the liquid passes through the inlet communication header pipe 2 and flows through the liquid pipelines 110 of the plurality of phase change suppression heat transfer heat exchange plates 11 in parallel and conducts heat to the phase change suppression working medium 109 in the closed network-shaped pipeline 108 adjacent on the phase change suppression heat transfer heat exchange plate 11 through the pipe wall, so that the temperature on the entire phase change suppression heat transfer heat exchange plate 11 is even, and performs heat exchange with the air flowing through the phase change suppression heat transfer heat exchange plate 11, so that the corresponding air temperature arises, the temperature of the liquid flowing through the phase change suppression heat transfer heat exchange plate 11 decreases, and the liquid with temperature decreased flows into the outlet communication header pipe 3 and into the liquid system to perform the next round of heat exchange cycle.

Embodiment 2

Referring to FIGS. 5 to 9, the present invention also provides a phase change suppression heat transfer plate-type heat exchanger. The structure of the phase change suppression heat transfer plate-type heat exchanger in this embodiment is substantially the same as that of the phase change suppression heat transfer plate-type heat exchanger in embodiment I. The differences lie in that: the distribution location of the liquid pipeline 110 on the surface of the phase change suppression heat transfer heat exchange plate 11 is different; the angles between the surface of the phase change suppression heat transfer heat exchange plate 11 and the inlet communication header pipe 2 and the outlet communication header pipe 3 are different; and the installation direction of the phase change suppression heat transfer plate-type heat exchanger during actual application is different.

Figure 7:
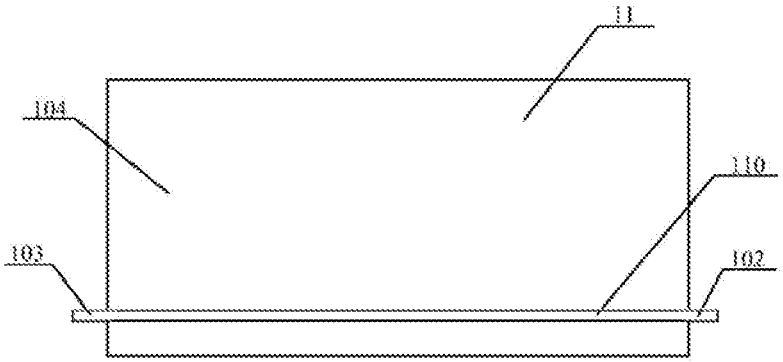
FIG. 7 illustrates a structure view of a liquid pipeline in a phase change suppression heat transfer heat exchange plate in the phase change suppression heat transfer plate-type heat exchanger according to embodiment II of the present invention.
Figure 8:
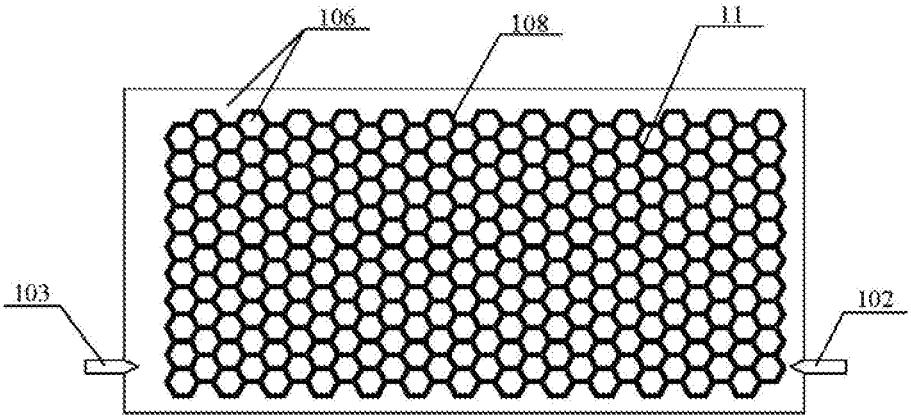
FIG. 8 illustrates a structure view of a closed network-shaped pipeline in the phase change suppression heat transfer heat exchange plate in the phase change suppression heat transfer plate-type heat exchanger according to embodiment II of the present invention.
Figure 9:
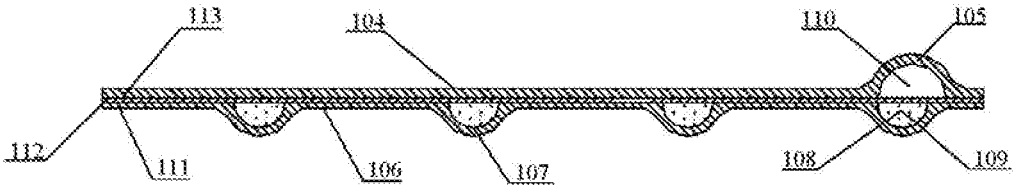
FIG. 9 illustrates a partial section structure view of the phase change suppression heat transfer heat exchange plate in the phase change suppression heat transfer plate-type heat exchanger according to embodiment II of the present invention.

In particular, in embodiment I, the liquid pipeline 110 is preferably located on the longitudinal central line of the phase change suppression heat transfer heat exchange plate 11. However, in this embodiment, as shown in FIG. 7, the liquid pipeline 110 is close to one side of the phase change suppression heat transfer heat exchange plate.

Figure 6:
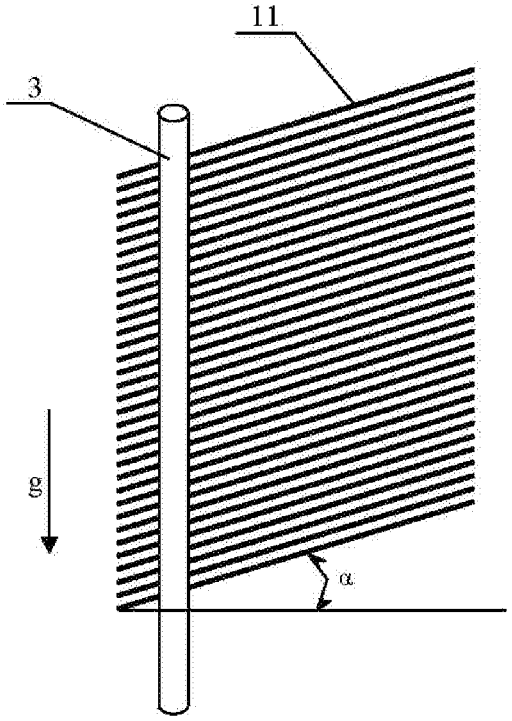
FIG. 6 illustrates a side structure view of the phase change suppression heat transfer plate-type heat exchanger according to embodiment II of the present invention.

In particular, in embodiment I, the surface of the phase change suppression heat transfer heat exchange plate 11 is preferably perpendicular to the inlet communication header pipe 2 and the outlet communication header pipe 3. That is, the angles between the surface of the phase change suppression heat transfer heat exchange plate 11 and the inlet communication header pipe 2 and the outlet communication header pipe 3 are preferably 90 degrees. However, in this embodiment, as shown in FIG. 6, the angles between the surface of the phase change suppression heat transfer heat exchange plate 11 and the inlet communication header pipe 2 and the outlet communication header pipe 3 are less than 90 degrees. That is, the phase change suppression heat transfer heat exchange plate 11 tilts to a certain angle relative to the inlet communication header pipe 2 and the outlet communication header pipe 3.

Figure 5:
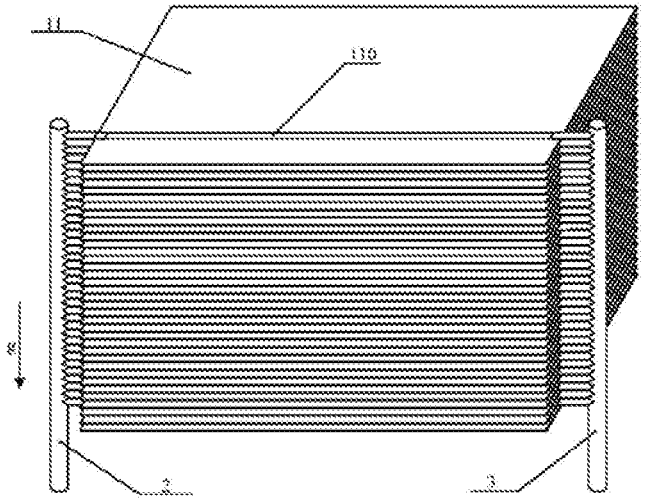
FIG. 5 illustrates a perspective structure view of a phase change suppression heat transfer plate-type heat exchanger according to embodiment II of the present invention.

In particular, in embodiment I, the preferred installation direction of the phase change suppression heat transfer plate-type heat exchanger is that the phase change suppression heat transfer heat exchange plate 11 and the liquid pipeline 110 are both vertically downward and perpendicular to the horizontal plane; the inlet communication header pipe 2 is located below the phase change suppression heat transfer heat exchange plate 11, the outlet communication header pipe 3 is located above the phase change suppression heat transfer heat exchange plate 11, and the inlet communication header pipe 2 and the outlet communication header pipe 3 are both parallel to the horizontal plane. However, in this embodiment, as shown in FIGS. 5 and 6, the arrowed indicated with g represents the gravity direction, that is, the vertically downward direction. The preferred installation direction of the phase change suppression heat transfer plate-type heat exchanger is that the inlet communication header pipe 2 and the outlet communication header pipe 3 are both perpendicular to the horizontal plane. The phase change suppression heat transfer heat exchange plate 11 forms a certain angle a relative to the horizontal plane. The liquid pipeline 110 is parallel to the horizontal plane. Preferably, the angle a between the phase change suppression heat transfer heat exchange plate 11 and the horizontal plane is 3°~85°.

It should be noted that when the phase change suppression heat transfer plate-type heat exchanger is used for heat dissipation, that is, the liquid temperature in the liquid pipeline 110 is relative high and the heat of the liquid in the liquid pipeline 110 needs to be dissipated into the air for cooling the liquid, the phase change suppression heat transfer heat exchange plate 11 tilts upwards relative to the horizontal plane as shown in FIG. 6; and when the phase change suppression heat transfer plate-type heat exchanger is used for heating, that is, the liquid temperature in the liquid pipeline 110 is relatively low and the liquid needs to be heated by the heat exchanger, the phase change suppression heat transfer heat exchange plate 11 tilts downwards relative to the horizontal plane.

The other structures and features of the phase change suppression heat transfer plate-type heat exchanger are the same as those of the phase change suppression heat transfer plate-type heat exchanger in embodiment I, which can be in particular made reference to embodiment I and will not be described here anymore.

Embodiment 3

Figure 10:
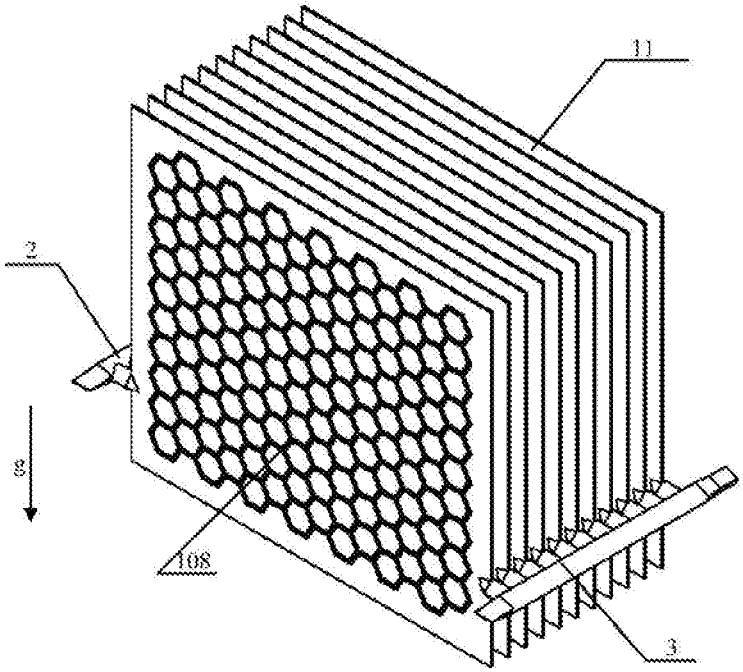
FIGS. 10 and 11 illustrate perspective structure views of a phase change suppression heat transfer plate-type heat exchanger according to embodiment III of the present invention.
Figure 11:
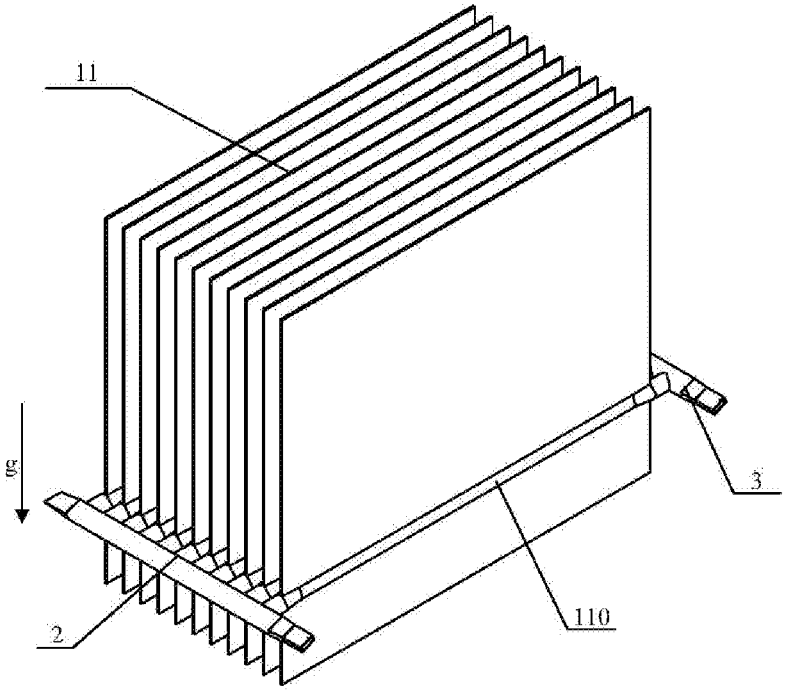

Referring to FIGS. 10 to 11, the present invention also provides a phase change suppression heat transfer plate-type heat exchanger. The structure of the phase change suppression heat transfer plate-type heat exchanger in this embodiment is substantially the same as that of the phase change suppression heat transfer plate-type heat exchanger in embodiment I. The differences lies in that: the distribution location of the liquid pipeline 110 on the surface of the phase change suppression heat transfer heat exchange plate 11 is different; and the installation direction of the phase change suppression heat transfer plate-type heat exchanger during actual application is different.

In particular, in embodiment I, the liquid pipeline 110 is preferably located on the longitudinal central line of the phase change suppression heat transfer heat exchange plate 11. However, in this embodiment, as shown in FIG. 7, the liquid pipeline 110 is close to one side of the phase change suppression heat transfer heat exchange plate.

In particular, in embodiment I, the preferred installation direction of the phase change suppression heat transfer plate-type heat exchanger is that the phase change suppression heat transfer heat exchange plate 11 and the liquid pipeline 110 are both vertically downward and perpendicular to the horizontal plane; the inlet communication header pipe 2 is located below the phase change suppression heat transfer heat exchange plate 11, the outlet communication header pipe 3 is located above the phase change suppression heat transfer heat exchange plate 11, and the inlet communication header pipe 2 and the outlet communication header pipe 3 are both parallel to the horizontal plane. However, in this embodiment, as shown in FIGS. 10 and 11, the arrowed indicated with g represents the gravity direction, that is, the vertically downward direction. The phase change suppression heat transfer heat exchange plate 11 is vertically downward and perpendicular to the horizontal plane; the inlet communication header pipe 2 and the outlet communication header pipe 3 are located at two sides of the phase change suppression heat transfer heat exchange plate 11 and both parallel to the horizontal plane; and the liquid pipeline 110 is parallel to the horizontal plane.

It should be noted that when the phase change suppression heat transfer plate-type heat exchanger is used for heat dissipation, that is, the liquid temperature in the liquid pipeline 110 is relative high and the heat of the liquid in the liquid pipeline 110 needs to be dissipated into the air for cooling the liquid, the phase change suppression heat transfer heat exchange plate 11 is as shown in FIGS. 10 and 11, the liquid pipeline 110 is close to the lower portion of the phase change suppression heat transfer heat exchange plate 11; and when the phase change suppression heat transfer plate-type heat exchanger is used for heating, that is, the liquid temperature in the liquid pipeline 110 is relatively low and the liquid needs to be heated by the heat exchanger, the liquid pipeline 110 is close to the upper portion of the phase change suppression heat transfer heat exchange plate 11, that is, the structures in FIGS. 10 and 11 are inverted by rotating 180 degrees under the premise of keeping the gravity direction constant.

The other structures and features of the phase change suppression heat transfer plate-type heat exchanger are the same as those of the phase change suppression heat transfer plate-type heat exchanger in embodiment I, which can be in particular made reference to embodiment I and will not be described here anymore.

Embodiment 4

Referring to FIGS. 12 to 15, the present invention also provides a phase change suppression heat transfer plate-type heat exchanger. The structure of the phase change suppression heat transfer plate-type heat exchanger in this embodiment is substantially the same as that of the phase change suppression heat transfer plate-type heat exchanger in embodiment I. The differences lies in that: the shape of the liquid pipeline 110 is different; the distribution location of the liquid pipeline 110 on the surface of the phase change suppression heat transfer heat exchange plate 11 is different; the distribution locations of the inlet communication header pipe 2 and the outlet communication header pipe 3 are different; and the installation direction of the phase change suppression heat transfer plate-type heat exchanger during actual application is different.

Figure 12:
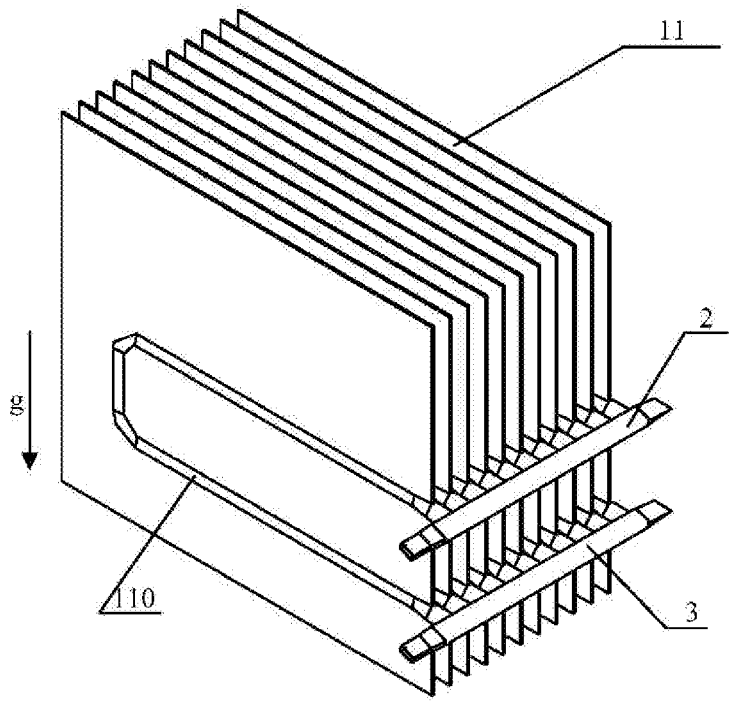
FIGS. 12 and 13 illustrate perspective structure views of a phase change suppression heat transfer plate-type heat exchanger according to embodiment IV of the present invention.
Figure 14:
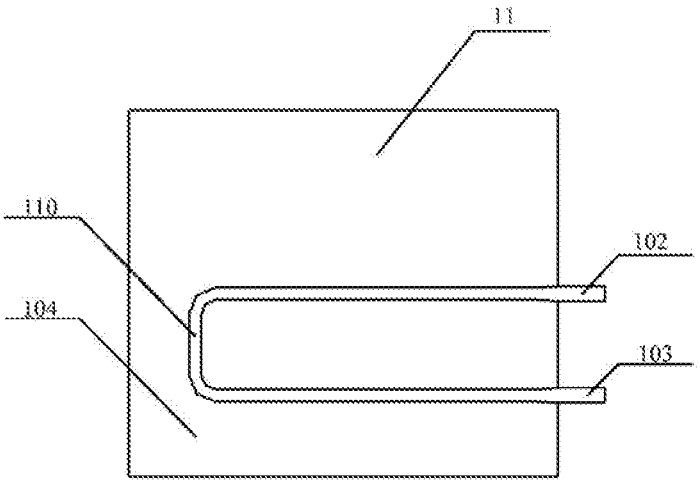
FIG. 14 illustrates a structure view of a liquid pipeline in a phase change suppression heat transfer heat exchange plate in the phase change suppression heat transfer plate-type heat exchanger according to embodiment IV of the present invention.
Figure 15:
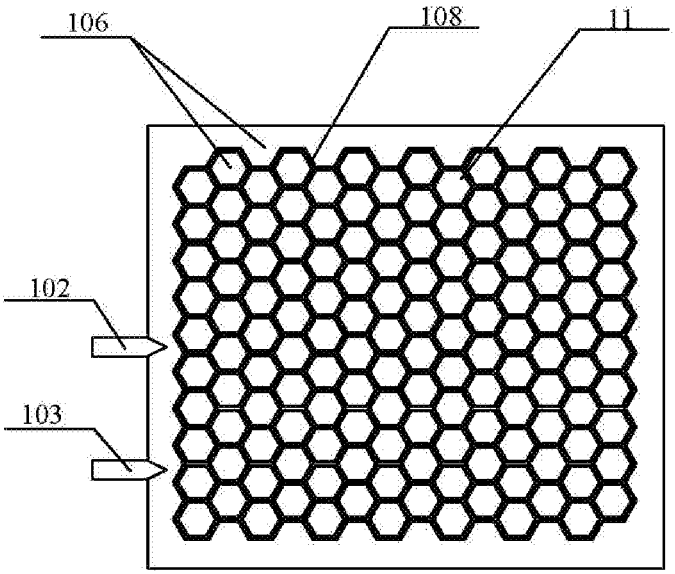
FIG. 15 illustrates a structure view of a closed network-shaped pipeline in the phase change suppression heat transfer heat exchange plate in the phase change suppression heat transfer plate-type heat exchanger according to embodiment IV of the present invention.

In particular, in embodiment I, the shape of the liquid pipeline 110 is preferably a rectilinear figure. However, in this embodiment, as shown in FIGS. 12 and 14, the shape of the liquid pipeline 110 is a U shape.

In particular, in embodiment I, the liquid pipeline 110 is preferably located on the longitudinal central line of the phase change suppression heat transfer heat exchange plate 11. However, in this embodiment, as shown in FIGS. 12 and 14, the liquid pipeline 110 is close to one side of the phase change suppression heat transfer heat exchange plate.

In particular, in embodiment I, the inlet communication header pipe 2 and the outlet communication header pipe 3 are preferably located at two opposite sides of the phase change suppression heat transfer heat exchange plate 11 respectively. However, in this embodiment, the inlet communication header pipe 2 and the outlet communication header pipe 3 are located at the same side of the phase change suppression heat transfer heat exchange plate 11.

Figure 13:
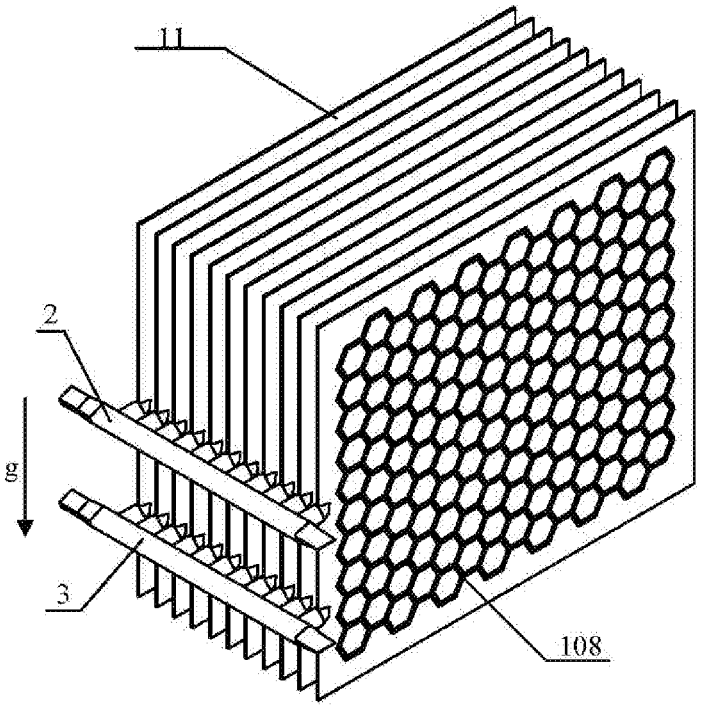

In particular, in embodiment I, the preferred installation direction of the phase change suppression heat transfer plate-type heat exchanger is that the phase change suppression heat transfer heat exchange plate 11 and the liquid pipeline 110 are both vertically downward and perpendicular to the horizontal plane; the inlet communication header pipe 2 is located below the phase change suppression heat transfer heat exchange plate 11, the outlet communication header pipe 3 is located above the phase change suppression heat transfer heat exchange plate 11, and the inlet communication header pipe 2 and the outlet communication header pipe 3 are both parallel to the horizontal plane. However, in this embodiment, as shown in FIGS. 12 and 13, the arrowed indicated with g represents the gravity direction, that is, the vertically downward direction. The phase change suppression heat transfer heat exchange plate 11 is vertically downward and perpendicular to the horizontal plane; the inlet communication header pipe 2 and the outlet communication header pipe 3 are located at one side of the phase change suppression heat transfer heat exchange plate 11 and both parallel to the horizontal plane; and the liquid pipeline 110 is parallel to the horizontal plane.

It should be noted that when the phase change suppression heat transfer plate-type heat exchanger is used for heat dissipation, that is, the liquid temperature in the liquid pipeline 110 is relative high and the heat of the liquid in the liquid pipeline 110 needs to be dissipated into the air for cooling the liquid, the phase change suppression heat transfer heat exchange plate 11 is as shown in FIGS. 12 and 13, the liquid pipeline 110 is close to the lower portion of the phase change suppression heat transfer heat exchange plate 11; and when the phase change suppression heat transfer plate-type heat exchanger is used for heating, that is, the liquid temperature in the liquid pipeline 110 is relatively low and the liquid needs to be heated by the heat exchanger, the liquid pipeline 110 is close to the upper portion of the phase change suppression heat transfer heat exchange plate 11, that is, the structures in FIGS. 12 and 13 are inverted by rotating 180 degrees under the premise of keeping the gravity direction constant.

The other structures and features of the phase change suppression heat transfer plate-type heat exchanger are the same as those of the phase change suppression heat transfer plate-type heat exchanger in embodiment I, which can be in particular made reference to embodiment I and will not be described here anymore.

Embodiment 5

Figure 16:
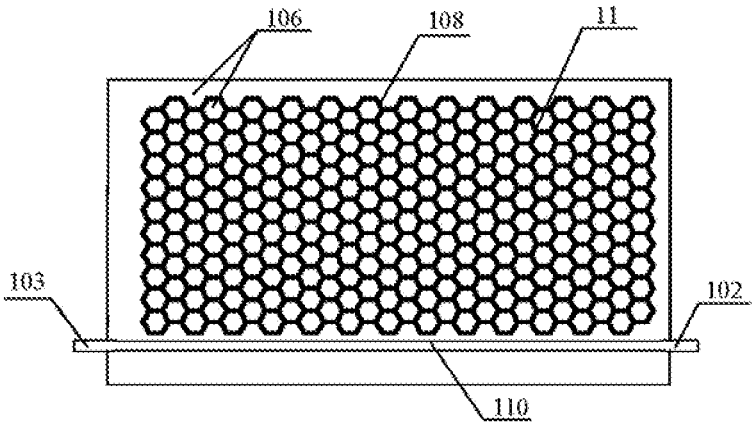
FIG. 16 illustrates a structure view of a liquid pipeline and a closed network-shaped pipeline in a phase change suppression heat transfer heat exchange plate in the phase change suppression heat transfer plate-type heat exchanger according to embodiment V of the present invention.
Figure 17:
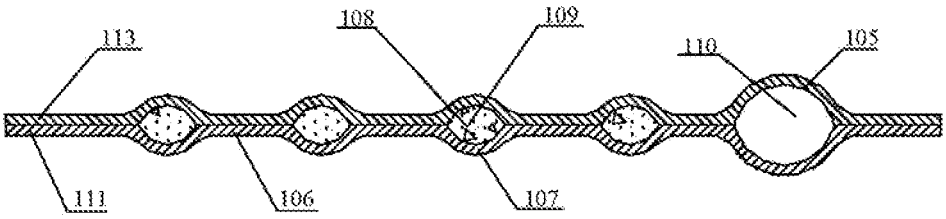
FIG. 17 illustrates a partial section structure view of the phase change suppression heat transfer heat exchange plate in the phase change suppression heat transfer plate-type heat exchanger according to embodiment V of the present invention.

Referring to FIGS. 16 to 17, the present invention also provides a phase change suppression heat transfer plate-type heat exchanger. The structure of the phase change suppression heat transfer plate-type heat exchanger in this embodiment is substantially the same as that of the phase change suppression heat transfer plate-type heat exchanger in embodiment I. The differences lies in that: the structure of the phase change suppression heat transfer heat exchange plate 11 is different; the locations of the first projection structure 107 corresponding to the closed network-shaped pipeline 108 and the second projection structure 105 corresponding to the liquid pipeline 110 on the phase change suppression heat transfer heat exchange plate 11 are different.

In particular, in embodiment I, the phase change suppression heat transfer heat exchange plate 11 includes a middle plate 112, a first plate 111 and a second plate 113; the first plate 111, the middle plate 112 and the second plate 113 are stacked successively, the first plate 111 and the second plate 113 are respectively located at two sides of the middle plate 113 and composited with the middle plate 113 by means of a rolling process. However, in this embodiment, the phase change suppression heat transfer heat exchange plate 11 includes the first plate 111 and the second plate 113; and the first plate 111 and the second plate 113 are composited by means of a rolling process.

In particular, in embodiment I, the first projection structure 107 and the second projection structure 105 are respectively formed on different surfaces of the phase change suppression heat transfer heat exchange plate 11, the closed network-shaped pipeline 108 is located between the middle plate 112 and the first plate 111, the first projection structure 107 is located on the first plate 111, the liquid pipeline 110 is formed between the middle plate 112 and the second plate 113, the second projection structure 105 is located on the second plate 113. However, in this embodiment, the first projection structure 107 and the second projection structure 105 are formed on the same surface of the phase change suppression heat transfer heat exchange plate 11, the closed network-shaped pipeline 108 and the liquid pipeline 110 are located between the first plate 111 and the second plate 113; and the first projection structure 107 and the second projection structure 105 are located on the first plate 111, the second plate 113, or both the first plate 111 and the second plate 113.

It should be noted that the first projection structure 107 and the second projection structure 105 being both located on the first plate 111 or the second plate 113 refers to that the phase change suppression heat transfer heat exchange plate 11 is in a single-surface expansion state, and the first projection structure 107 and the second projection structure 105 being both located on the first plate 111 and the second plate 113 refers to that the phase change suppression heat transfer heat exchange plate 11 is in a dual-surface expansion state. Preferably, in this embodiment, the first projection structure 107 and the second projection structure 105 being both located on the first plate 111 and the second plate 113.

It should be further noted that in this embodiment, during actual application, the installation direction of the phase change suppression heat transfer plate-type heat exchanger may be set according to the actual needs, which is not limited here.

The other structures and features of the phase change suppression heat transfer plate-type heat exchanger are the same as those of the phase change suppression heat transfer plate-type heat exchanger in embodiment I, which can be in particular made reference to embodiment I and will not be described here anymore.

In summary, the present invention provides a phase change suppression heat transfer plate-type heat exchanger. In the phase change suppression heat transfer heat exchange plate of the phase change suppression heat transfer plate-type heat exchanger, the liquid pipeline and the closed network-shaped pipeline are combined together, a phase change suppression working medium is filled in the closed network-shaped pipeline to a form phase change suppression heat transfer device, which improves the temperature equalization performance of the phase change suppression heat transfer heat exchange plate. As the heat conduction efficiency of the phase change suppression heat transfer device is high and the temperature equalization performance is good, the heat exchange temperature difference and the effective heat exchange area between the phase change suppression heat transfer device and the air is improved, the heat dissipation capability and heat exchange efficiency of the phase change suppression heat transfer heat exchange plate is greatly improved, the phase change suppression heat transfer plate-type heat exchanger is enabled to have features of temperature equalization and efficient heat exchange, which greatly shortens the length of the liquid pipeline, reduces flow resistance and power consumption and fluid use amount, and improves the efficiency and energy efficiency ratio of the heat exchanger.

The above embodiments merely illustrate the principles and effects of the present invention rather than limiting the present invention. Any person skilled in the art may modify or vary the above embodiments without departing from the spirit and scope of the present invention. Therefore, any equivalent modifications or variations made by those skilled in the art without departing from the spirit and technical concept of the present invention shall be covered by the claims of the present invention.

What is claimed is:

1. A phase change suppression heat transfer plate-type heat exchanger, wherein comprising: an inlet communication header pipe, an outlet communication header pipe and a plurality of phase change suppression heat transfer heat exchange plates arranged in parallel, the phase change suppression heat transfer heat exchange plate is a composite plate-type structure and is provided with a liquid pipeline and a closed network-shaped pipeline, wherein the closed networkshaped pipeline is filled with a phase change suppression working medium;

the inlet communication header pipe and the outlet communication header pipe are at least fixed at one side of the phase change suppression heat transfer heat exchange plate, the lengthwise directions of the inlet communication header pipe and the outlet communication header pipe extend along the parallel arrangement direction of the plurality of phase change suppression heat transfer heat exchange plates, and the interiors of the inlet communication header pipe and the outlet communication header pipe both communicate with the interior of the liquid pipeline;

wherein the liquid pipeline and the closed network-shaped pipeline are both formed by means of an inflation process, and a first projection structure corresponding to the closed network-shaped pipeline and a second projection structure corresponding to the liquid pipeline are formed on a surface of the phase change suppression heat transfer heat exchange plate; and wherein the first projection structure and the second projection structure are respectively formed on different surfaces of the phase change suppression heat transfer heat exchange plate.

2. The phase change suppression heat transfer plate-type heat exchanger according to claim 1, wherein the phase change suppression heat transfer heat exchange plate includes a middle plate, a first plate material and a second plate; the first plate, the middle plate and the second plate are stacked successively, the first plate and the second plate are respectively located at two sides of the middle plate and composited with the middle plate by means of a rolling process;

the closed network-shaped pipeline is located between the middle plate and the first plate, and the first projection structure is located on the first plate; and the liquid pipeline is located between the middle plate and the second plate, and the second projection structure is located on the second plate.

3. The phase change suppression heat transfer plate-type heat exchanger according to claim 1, wherein the inlet communication header pipe and the outlet communication header pipe are respectively formed on two opposite sides of the phase change suppression heat transfer heat exchange plate; and the shape of the liquid pipeline is a rectilinear figure.

4. The phase change suppression heat transfer plate- type heat exchanger according to claim 3, wherein the liquid pipeline is located on a longitudinal central line of the phase change suppression heat transfer heat exchange plate.

5. The phase change suppression heat transfer plate -type heat exchanger according to claim 3, wherein the liquid pipeline is close to one side of the phase change suppression heat transfer heat exchange plate.

6. The phase change suppression heat transfer plate-type heat exchanger according to claim 1, wherein the inlet communication header pipe and the outlet communication header pipe are located on the same side of the phase change suppression heat transfer heat exchange plate; and the shape of the liquid pipeline is a U shape.

7. The phase change suppression heat transfer plate-type heat exchanger according to claim 1, wherein the first projection structure and the second projection structure are formed on the same surface of the phase change suppression heat transfer heat exchange plate.

8. The phase change suppression heat transfer plate-type heat exchanger according to claim 7, wherein the first projection structure and the second structure are both formed on two surfaces of the phase change suppression heat transfer heat exchange plate.

9. The phase change suppression heat transfer plate-type heat exchanger according to claim 7, wherein the phase change suppression heat transfer heat exchange plate includes a first plate and a second plate; and the first plate and the second plate are composited together by means of a rolling process; and the closed network-shaped pipeline and the liquid pipeline are located between the first plate and the second plate; and the first projection structure and the second projection structure are both located on the first plate, on the second plate, or on the first plate and the second plate.

10. The phase change suppression heat transfer plate-type heat exchanger according to claim 7, wherein the inlet communication header pipe and the outlet communication header pipe are respectively formed at two ends of the phase change suppression heat transfer heat exchange plate; and the shape of the liquid pipeline is a rectilinear figure and the liquid pipeline is close to one side of the phase change suppression heat transfer heat exchange plate.

11. The phase change suppression heat transfer plate-type heat exchanger according to claim 1, wherein one end of the inlet communication header pipe and the outlet communication header pipe is closed and the other end is connected to a liquid system.

12. The phase change suppression heat transfer plate-type heat exchanger according to claim 1, wherein the surface of the phase change suppression heat transfer heat exchange plate is perpendicular to the inlet communication header pipe and the outlet communication header pipe or tilts to a certain angle relative to the inlet communication header pipe and the outlet communication header pipe.

* * * * *